US008977173B2

(12) United States Patent
Matsubara et al.

(10) Patent No.: US 8,977,173 B2
(45) Date of Patent: Mar. 10, 2015

(54) FIXING APPARATUS HAVING COVER MEMBER AND IMAGE FORMING APPARATUS

(71) Applicant: Canon Kabushiki Kaisha, Tokyo (JP)

(72) Inventors: Hideyuki Matsubara, Mishima (JP); Masato Suzuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/952,449

(22) Filed: Jul. 26, 2013

(65) Prior Publication Data

US 2014/0037345 A1 Feb. 6, 2014

(30) Foreign Application Priority Data

Jul. 31, 2012 (JP) ..... 2012-169834

(51) Int. Cl.
*G03G 15/20* (2006.01)
*G03G 15/00* (2006.01)
*G03G 15/23* (2006.01)

(52) U.S. Cl.
CPC ..... *G03G 15/2017* (2013.01); *G03G 15/6573* (2013.01); *G03G 15/6552* (2013.01); *G03G 15/234* (2013.01)
USPC ..... 399/322; 399/405

(58) Field of Classification Search
CPC ..... G03G 15/2017; G03G 15/6552; G03G 15/6573
USPC ..... 399/322, 405
See application file for complete search history.

(56) References Cited

U.S. PATENT DOCUMENTS

| | | | | |
|---|---|---|---|---|
| 6,167,220 | A * | 12/2000 | Lewis et al. | 399/92 |
| 6,226,474 | B1 * | 5/2001 | Kowalski et al. | 399/92 |
| 2006/0067748 | A1 * | 3/2006 | Mori | 399/320 |
| 2010/0310262 | A1 * | 12/2010 | Nanayama | 399/23 |
| 2012/0121286 | A1 * | 5/2012 | Suzuki | 399/67 |
| 2012/0301174 | A1 * | 11/2012 | Masuda | 399/92 |

FOREIGN PATENT DOCUMENTS

| | | | |
|---|---|---|---|
| JP | 4-291277 | A | 10/1992 |
| JP | 6-075492 | A | 3/1994 |
| JP | 2006-322994 | A | 11/2006 |

* cited by examiner

*Primary Examiner* — Ryan Walsh
(74) *Attorney, Agent, or Firm* — Canon U.S.A., Inc. IP Division

(57) ABSTRACT

A fixing apparatus includes a fixing unit configured to heat and fix an unfixed image, which is formed on a recording material, on the recording material, a rotating member provided with a metal shaft and configured to convey the recording material that has passed through the fixing unit, a cover member made of injection-molded resin and configured to cover the shaft of the rotating member from a recording material conveyance path side so that a portion of the rotating member in contact with the recording material is exposed, the cover member including a portion that has a U-shaped cross-section when viewed from one end side of the shaft, and a sheet member configured to cover an opening of the U-shaped portion of the cover member.

12 Claims, 10 Drawing Sheets

FIXING APPARATUS HAVING COVER MEMBER AND IMAGE FORMING APPARATUS

BACKGROUND OF THE INVENTION

1. Field of the Invention

The present invention relates to a fixing apparatus that heats a recording material bearing an unfixed image, and an image forming apparatus, such as a copying machine and a printer, that includes the fixing apparatus.

2. Description of the Related Art

A fixing apparatus that heats and fixes an unfixed image formed on a recording material onto the recording material is mounted on an image forming apparatus that forms an image on a recording material using an image forming process, such as an electrophotographic process.

If printing on a moist recording material is started when an image forming apparatus is in a cold state, water vapor produced by the fixing apparatus condenses on cold portions in the image forming apparatus. Japanese Patent Application Laid-Open No. 2006-322994 discusses countermeasures against such condensation.

However, a rotating member that conveys the recording material often has a shaft that is made of metal, and metal is susceptible to condensation due to its large heat capacity. If condensation forms on the shaft of the rotating member, droplets can form and adhere to the recording material passing through the position of the rotating member, causing the quality of the output image to deteriorate.

SUMMARY OF THE INVENTION

The present invention is directed to a fixing apparatus that suppresses, while suppressing costs, the adherence of water droplets on a recording material even if condensation forms.

According to an aspect of the present invention, a fixing apparatus includes a fixing unit configured to heat and fix an unfixed image, which is formed on a recording material, a rotating member provided with a metal shaft and configured to convey the recording material that has passed through the fixing unit, a cover member made of injection-molded resin and configured to cover the metal shaft of the rotating member from a recording material conveyance path side so that a portion of the rotating member in contact with the recording material is exposed, the cover member including a U-shaped portion that has a U-shaped cross-section when viewed from one end side of the metal shaft, and a sheet member configured to cover an opening of the U-shaped portion of the cover member.

According to another aspect of the present invention, an image forming apparatus includes an image forming unit configured to form an unfixed image on a recording material, a fixing unit configured to heat and fix the unfixed image formed on the recording material, a rotating member provided with a metal shaft and configured to convey the recording material that has passed through the fixing unit, a cover member made of injection-molded resin and configured to cover the metal shaft of the rotating member from a recording material conveyance path side so that a portion of the rotating member in contact with the recording material is exposed, the cover member including a U-shaped portion that has a U-shaped cross-section when viewed from one end side of the metal shaft, and a sheet member configured to cover an opening of the U-shaped portion of the cover member.

Further features of the present invention will become apparent from the following description of exemplary embodiments with reference to the attached drawings.

DESCRIPTION OF THE EMBODIMENTS

Figure 1:
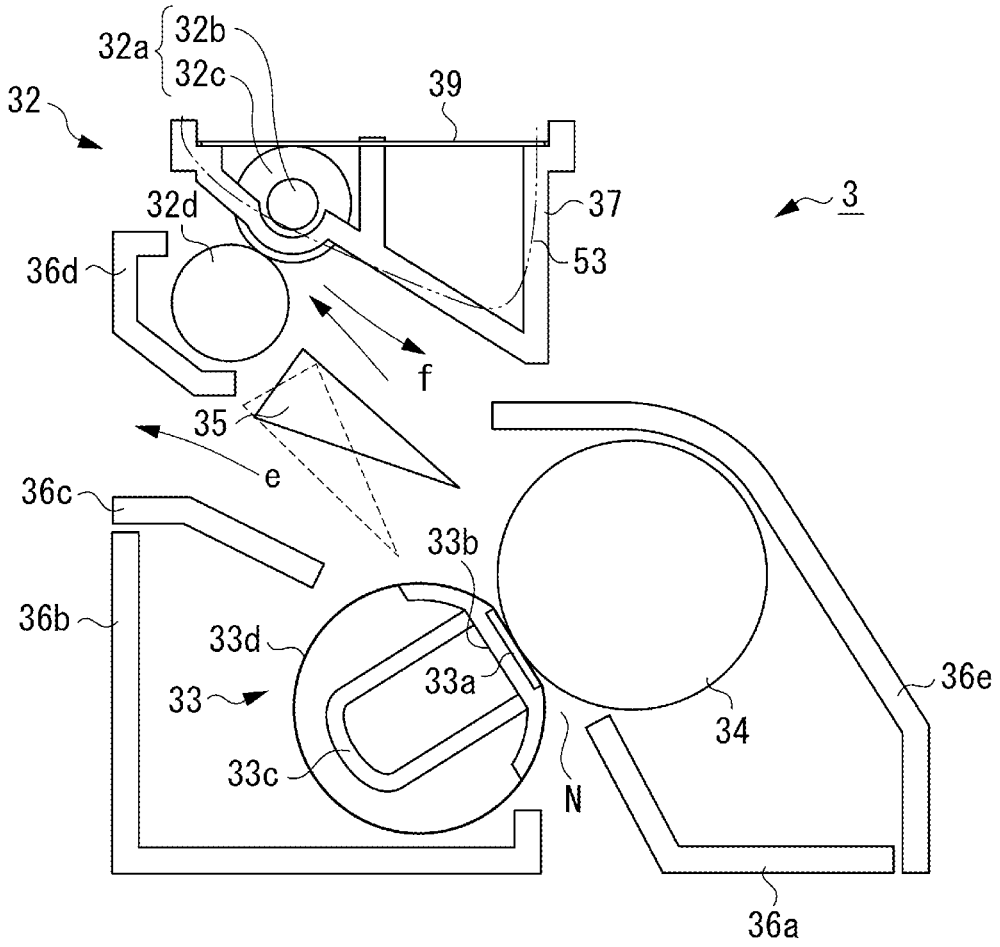
FIG. 1 is a cross-sectional view of a fixing unit (fixing apparatus).
Figure 2:
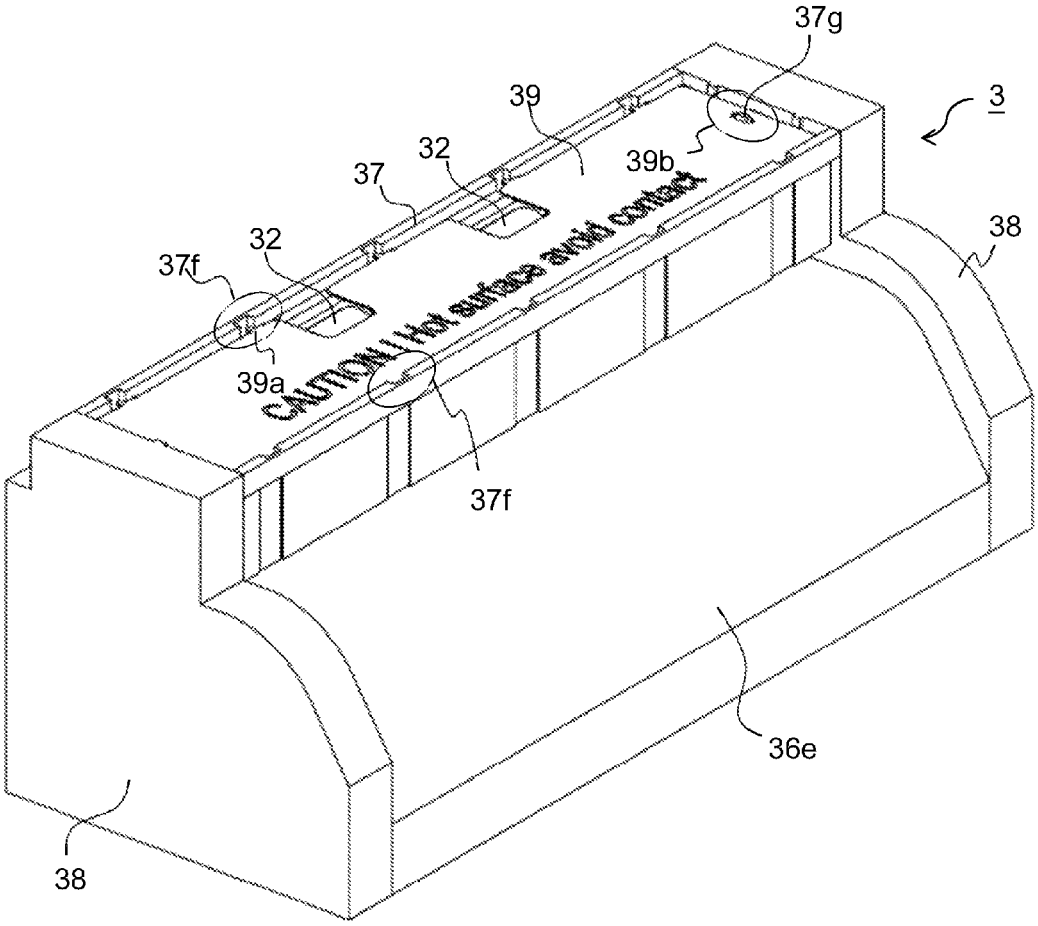
FIG. 2 is an external perspective view of the fixing unit.
Figure 3:
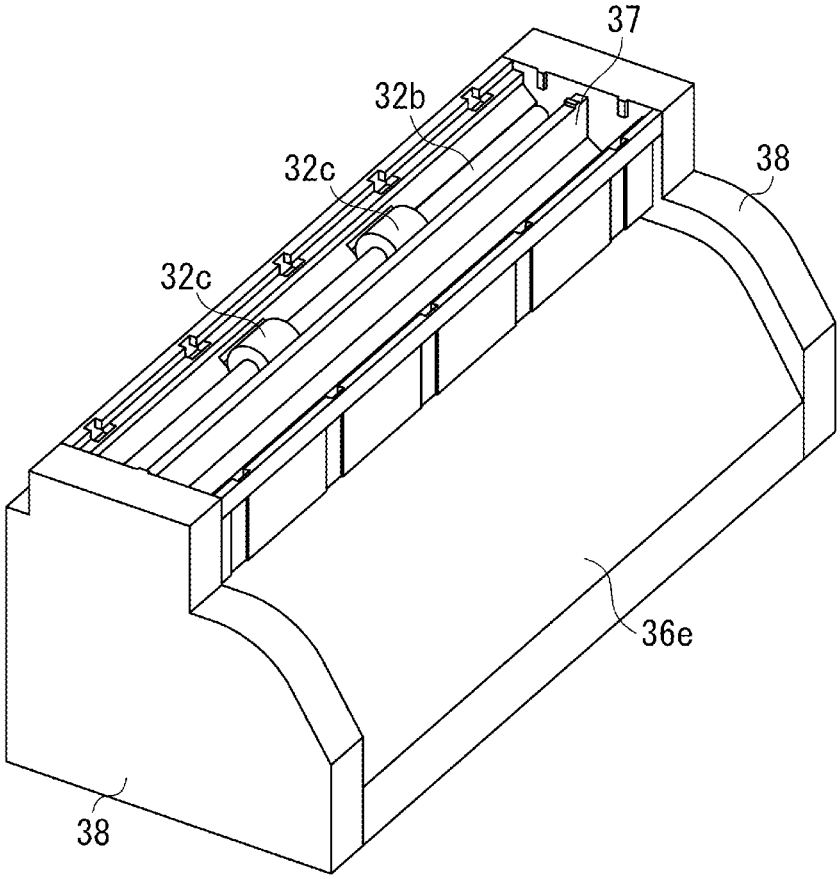
FIG. 3 is an external perspective view of a state in which a sheet member is removed from the fixing unit.
Figure 4:
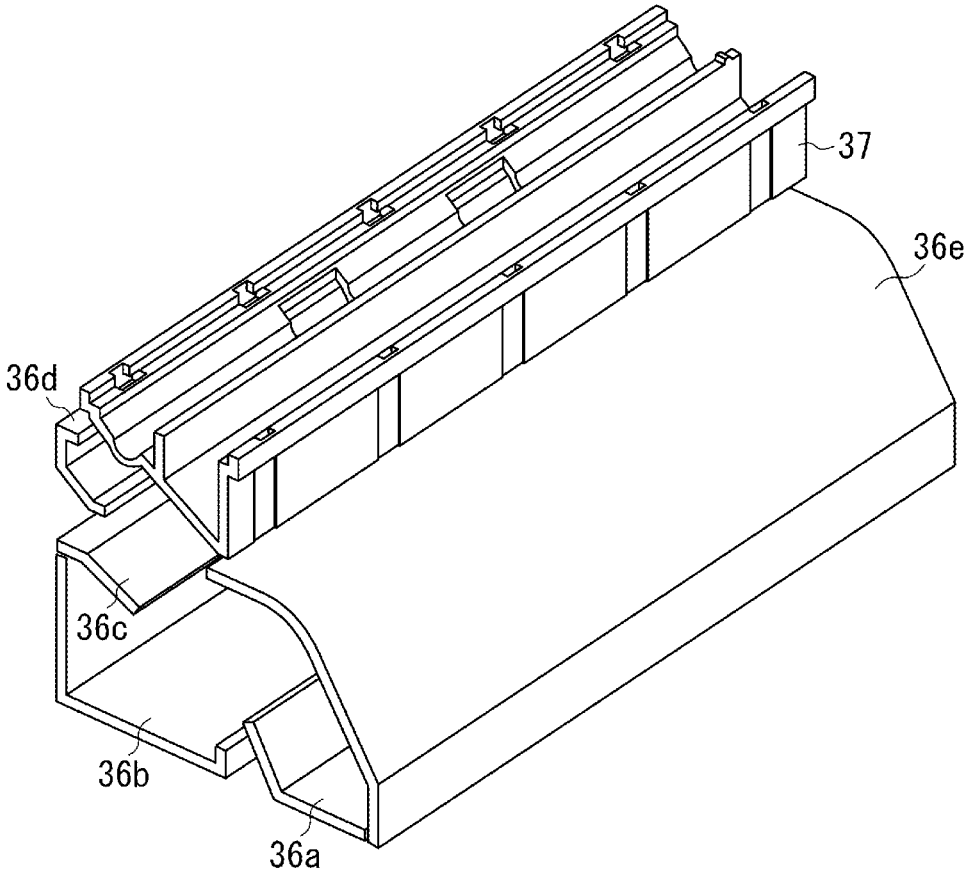
FIG. 4 is a perspective view illustrating a layout of a cover member when a side cover is removed.
Figure 5A:
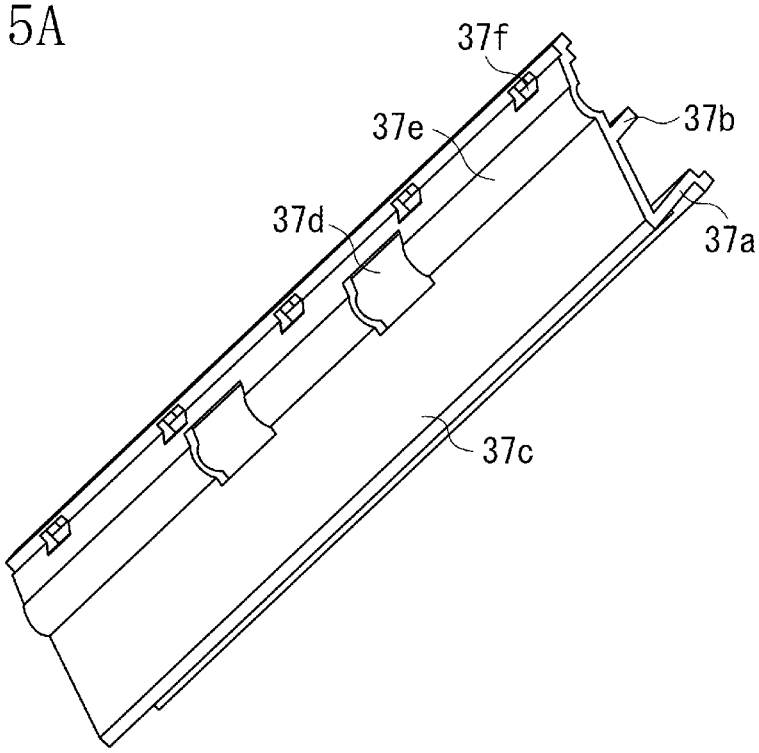
FIG. 5A is a view of the cover member as seen from a recording member guide face side (lower side in FIG. 1)
Figure 5B:
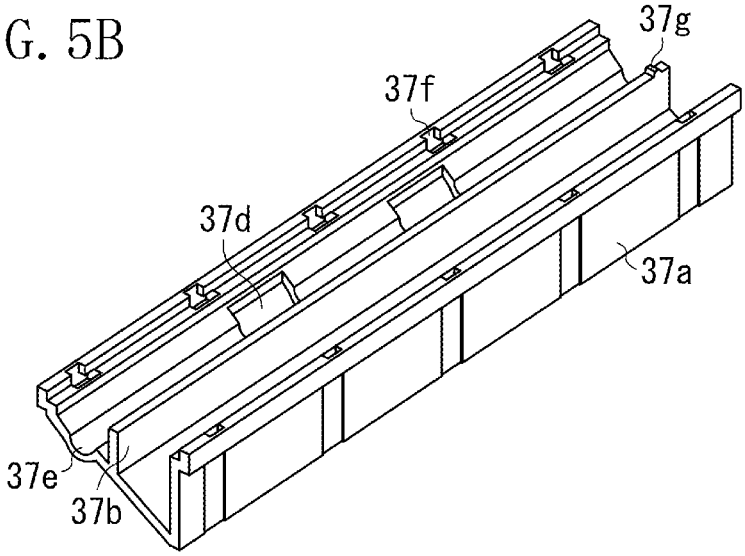
FIG. 5B is a view of the cover member as seen from above in FIG. 1.
Figure 6:
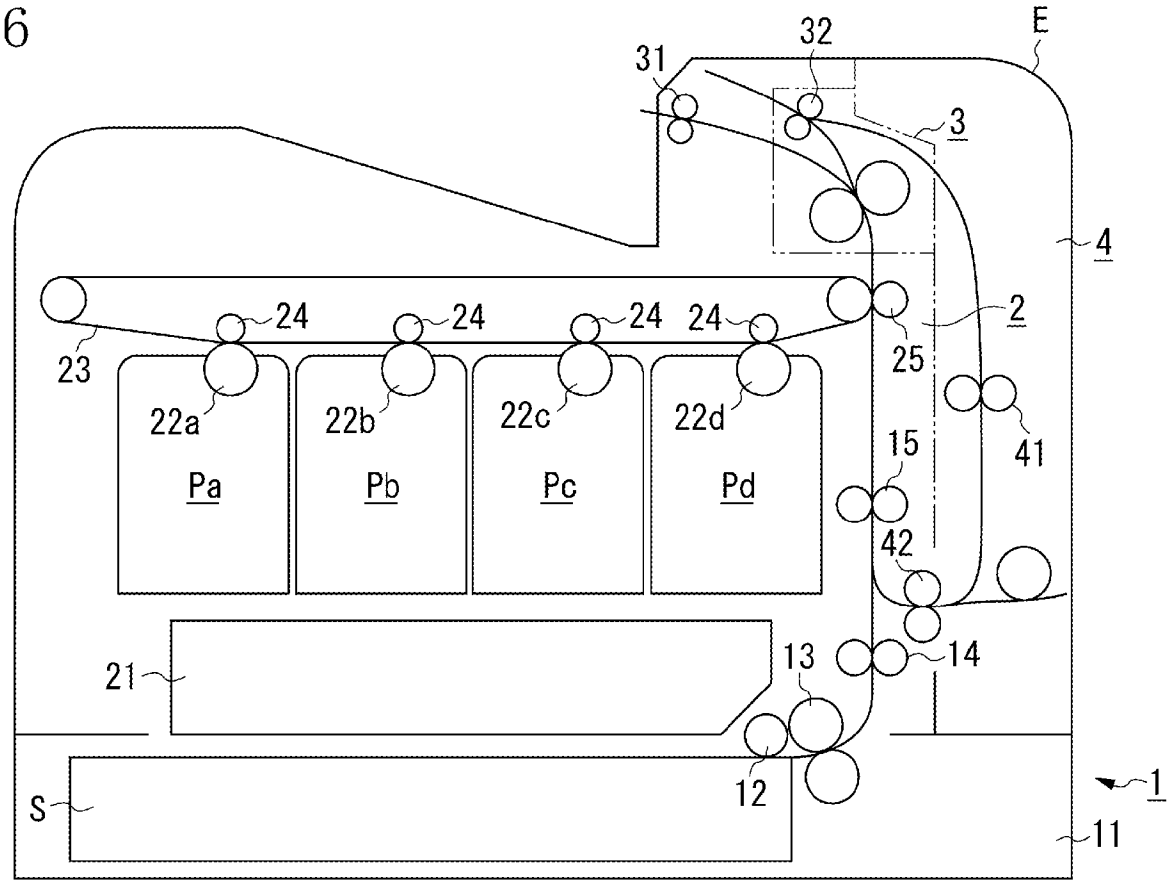
FIG. 6 is a cross-sectional view of a color laser printer.

A first exemplary embodiment according to the present invention will be described with reference to FIGS. 1 to 6. FIG. 1 is a cross-sectional view of a fixing unit (fixing apparatus). FIG. 2 is an external perspective view of the fixing unit. FIG. 3 is an external perspective view of a state in which a below-described sheet member 39 has been removed from the fixing unit. FIG. 4 is a perspective view illustrating a layout of a cover member when a below-described side cover 38 has been removed. FIG. 5A is a view of a cover member 37 as seen from the side of a recording member guide face 37*c* (lower side of FIG. 1), and FIG. 5B is a view of the cover member 37 as seen from above in FIG. 1. FIG. 6 is a cross-sectional view of a color laser printer.

First, a schematic overall configuration will be described with reference to FIG. 6 by following the flow of a recording material S. A printer main body E forms an image by an electrophotographic process. When a print instruction is input, the recording material S is conveyed from a paper feed unit 1 to an image forming unit 2, and a toner image is transferred onto the recording material S. The recording material S is conveyed to a fixing unit 3, the toner image is heated and fixed to the recording material, and then the recording material is discharged to a discharge unit. Specifically, a cassette 11, which stores the recording material S at a lower portion of the apparatus, is mounted on the apparatus main body E to be attachable and detachable. The recording material S stored in the cassette 11 is fed out by a pickup roller 12 and a feeding roller 13, and is sent to the image forming unit 2 by pairs of conveyance rollers 14 and 15. Further, the pair of conveyance rollers 15 has a function of registering the leading edge of the recording material.

The image forming unit 2 includes first to fourth image forming units (Pa, Pb, Pc, and Pd). Each image forming unit forms a respective color image of, in order, yellow, magenta, cyan, and black. Except for the toner color being different, the configuration of these image forming units is the same. Accordingly, in the following description, although the reference symbols a, b, c, and d illustrated in FIG. 3 indicate members corresponding to the yellow, magenta, cyan, and black image forming units, respectively, unless necessary, the reference symbols a, b, c, and d will be omitted.

In the image forming unit 2, a laser beam according to image information is irradiated on a photosensitive member 22 by a laser scanner 21 to form an electrostatic latent image on the photosensitive member 22. This electrostatic latent image is developed into a toner image by a development unit. The toner image formed on the photosensitive member 22 is transferred onto an intermediate transfer belt 23 by applying a bias with a primary transfer roller 24. Then, a full color image, in which the four color toner images are superimposed, on the intermediate transfer belt 23 is conveyed to a secondary transfer unit, and is transferred onto the recording material S by a secondary transfer roller 25.

The recording material S bearing the unfixed image is conveyed to a fixing portion that forms a fixing nip portion, and is subjected to fixing processing. The recording material S that has passed through the fixing portion and finished fixing processing is conveyed by a pair of discharge rollers 31, and discharged to the discharge unit at an upper portion of the apparatus. In order to deal with periodic replacements and recording materials that have jammed, the fixing unit 3 that includes the fixing portion can be removed by the user from the printer main body after a reversing conveyance unit 4 has been opened.

Next, two-sided printing of the recording material S will be described. When performing recording on both sides of a recording material S, the recording material S that has passed through the fixing portion and on which an image has been recorded on a front face side is guided to a reversing roller 32 by a flapper, and is switched back by a reverse drive of the reversing roller 32. Then, the recording material S is again conveyed to the image forming unit 2 by conveyance rollers 41 and 42. Image recording is performed on the back side face of the recording material S in the same manner as in one-sided printing, and the recording material S is then discharged.

Next, a configuration of the fixing unit will be described with reference to FIGS. 1 to 5A and 5B. The fixing unit (fixing apparatus) 3 forms a fixing nip portion N between a heating unit 33 and a pressure roller 34. The heating unit 33 includes a fixing film 33*d*, a heater 33*a* in contact with an inner face of the fixing film, a holder 33*b* that supports the heater, and a reinforcement plate 33*c*. The pressure roller 34 is a roller formed of an elastic layer of silicone rubber, fluorocarbon rubber and the like, on a cored bar. The heating unit 33 and the pressure roller 34 form the fixing nip portion N by the application of pressure by a pressure applying mechanism. By passing the recording material S through the fixing nip portion N, the unfixed image on the recording material S is heated and fixed to the recording material.

A flapper 35 is arranged near the fixing portion N and downstream of a conveyance direction of the recording material S. This flapper 35 switches the destination of the recording material S between a discharge conveyance path e and a reversing conveyance path f. The flapper 35 is moved by a solenoid (not illustrated) provided in the apparatus main body E. A pair of reversing rollers 32 (rotating members that convey a recording material which has passed through the fixing portion) is provided in the reversing conveyance path f. The recording material S is switched back and conveyed during two-sided printing by rotating the pair of reversing rollers 32 in the forward and reverse direction. The pair of reversing rollers 32 are configured by a drive roller 32*a* and a pinch roller 32*d*. The drive roller 32*a* is configured by a rubber roller 32*c* that is attached to a metal shaft 32*b*. The pinch roller 32*d* is made of resin, and is urged toward the drive roller 32*a* by a spring (not illustrated).

Cover members 36*a*, 36*b*, 36*c*, 36*d*, 36*e*, and 37 are provided on an external side of the fixing unit 3. These cover members guide the recording material S that is conveyed through the upstream side, the downstream side, and the reversing conveyance path f of the fixing portion N. Further, a side cover 38 is attached to either end of the cover members. These covers, which are produced by injection molding, have a basic thickness of about 2.0 mm. The rigidity of part is ensured by providing a rib or the like. FIG. 4 is a perspective view that facilitates an understanding of the shape of each cover member by illustrating the layout of each cover member when the side cover 38 has been removed. Examples of materials that can be used for the cover members and the side cover include poly-carbonate (PC)+acrylonitrile butadiene styrene (ABS), poly-phenylene ether (PPE)+poly-styrene (PS), poly-phenylene oxide (PPO)+PS, poly-ethylene terephthalate (PET) and the like.

The cover member 37 (which also has a conveyance guide function) provided in the reversing conveyance path f is made of the same material as the other cover members, and is produced by injection molding. The cover member 37 has a "U" shape (refer to a chain line 53 in FIG. 1) to perform injection molding with a cavity and a core. Further, the cover member 37 covers the metal shaft 32*b* of the drive roller 32*a* in conveyance path side of the recording material S. Consequently, the upper portion in FIG. 1 is the open part of the U-shape. As illustrated in FIG. 5, two rib members 37*a* and 37*b* are provided on the cover member 37. Further, a hole portion 37*d* is for exposing the rubber roller 32*c* of the drive roller 32*a* to the recording material conveyance path from the recording member guide face 37*c*. A shaft cover portion 37*e* is for covering the metal shaft 32*b* of the drive roller 32*a* from the recording material conveyance path. The metal shaft 32*b* of the drive roller 32*a* is held by the side cover 38, and the metal shaft 32*b* and the shaft cover portion 37*e* are not in contact.

A sheet member 39 is attached to an upper opening portion of the cover member 37. Since the sheet member is a thin material of about 0.4 mm, the apparatus main body E can be made more compact. The sheet member 39 is attached to the cover member 37 by fitting protrusions 39*a* that are provided at a plurality of locations on the sheet member 39 into notched portions 37*f* provided at a plurality of locations on the cover member 37. At this stage, a hole portion 39*b* of the sheet member 39 is engaged with and attached to a protrusion 37*g* provided on the cover member 37 by the sheet member 39 bending. Therefore, assembly is simple, and disassembly using tools is easy. Further, such a configuration prevents deformation and disengagement due to differences in thermal expansion, and the occurrence of floating and peeling due to outgas produced by the resin being heated.

The sheet member 39 is a thinner member than the cover members 36 and 37, which form the fixing unit 3. The sheet member 39 is produced by being molded into a sheet-shape by extrusion molding, for example, and punched into the final shape. Therefore, since a mold for injection molding is not required, the sheet member 39 is inexpensive. Further, the sheet member 39 is made of a thin and transparent material (e.g., PC, PET, etc.), and a user warning (a marking warning of high temperatures) is printed by silk printing from the rear face of the sheet member 39. Since the flat portion of the sheet member 39 is wide, a printable area is wide and printing is easy. Further, printing flexibility is also high. In addition, since it is not necessary to add a label or the like, production costs are low.

However, if printing on a moist recording material is started when an image forming apparatus is in a cold state, water vapor that is produced from the recording material may condense on cold portions in the image forming apparatus. The rotating member (e.g., the drive roller 32*a*) that conveys the recording material often has a shaft made of metal, and metal is susceptible to condensation due to its large heat capacity. If condensation forms on the shaft of the rotating member, droplets can form and adhere to the recording material passing through the position of the rotating member, causing the quality of the output image to deteriorate.

Figure 7:
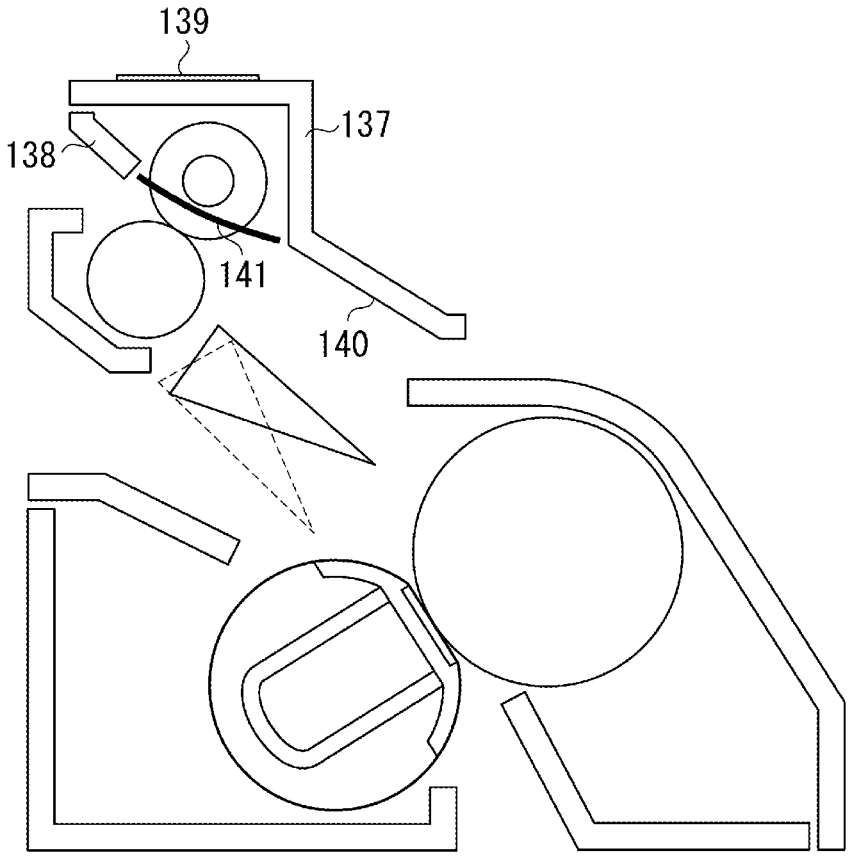
FIG. 7 is a cross-sectional view of a fixing unit of a comparative example.

One way to counter this is to cover the metal shaft by providing a sheet 141 between cover members 137 and 138, like in the comparative example illustrated in FIG. 7. However, because it is necessary not to inhibit movement of the recording material near the metal shaft, a fairly high degree of accuracy is required. For example, the portion between the sheet 141 and a convey guide unit 140 of the recording material, and the portion between the sheet 141 and the cover member 138 have to be smoothly connected. Therefore, it is difficult to cover the metal shaft with the sheet 141 for which it is hard to achieve shape accuracy.

Although an injection-molded resin member may be used instead of the sheet 141 to achieve shape accuracy, and the metal shaft may be covered with that member, this leads to an increase in the number of injection molded members and in costs. Although it is also necessary to use injection-molded parts for the cover members 137 and 138, since they are manufactured using molds, it is difficult to integrally form the member covering the metal shaft and the cover member 137. Therefore, these parts have to be produced using separate molds, and the increase in the number of molds causes costs to increase by that amount. Further, when attaching a label 139 warning of high temperatures, costs also increase by that amount, too.

Accordingly, in the present exemplary embodiment, the metal shaft 32*b* is covered from the recording material conveyance path side by the cover member 37 so that the portion (the rubber roller 32*c*) of the rotating member (e.g., the drive roller 32*a*) in contact with the recording material is exposed. Since the metal shaft is covered from the recording material conveyance path side, the adherence of water droplets on the recording material passing through the conveyance path can be suppressed even if condensation is formed on the metal shaft. Further, if the shape of the cover member 37 has a shape like that illustrated in FIGS. 1 and 5, namely, a portion that has a U-shaped cross-section when viewed from one end of the metal shaft, the cover member 37 can be injection-molded as a single part. However, in this case, the upper portion is the open part of the U-shaped. Accordingly, this open part is covered by the sheet member 39 that has been produced by punching. Further, since the strength that is required as a cover is ensured by the cover member 37, the member covering the open part of the upper portion of the cover member 37 does not have to be strong. Therefore, the open part is covered by the sheet member 39 that can be produced inexpensively yet thinly. In addition, by printing a marking warning of high temperatures on the sheet member 39, it is not necessary to attach a separate sticker. Still further, if the sheet member is transparent, since the user warning printed on the sheet member 39 is printed over a wide printing area, and is printed from a transparent back face, the warning has high user visibility.

Figure 8:
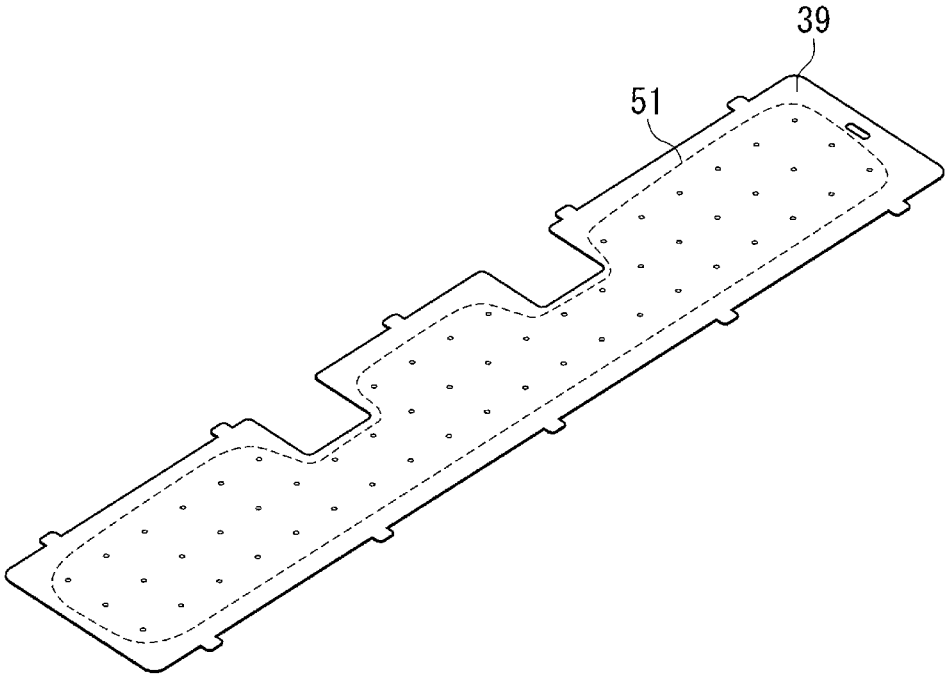
FIG. 8 is a perspective view illustrating another example of the sheet member.

Another example of the sheet member 39 will now be described with reference to FIG. 8. Since the sheet member 39 is a thin material, many thin holes 51 of about 1 mm in diameter, for example, can be formed. Consequently, water vapor that is produced in the fixing device can escape, and condensation is also less likely to form. Further, the user access face of the sheet member 39 may be subjected to embossing or surface texturing to make it more difficult to feel the high temperatures even if the user touches the sheet member 39.

Figure 9:
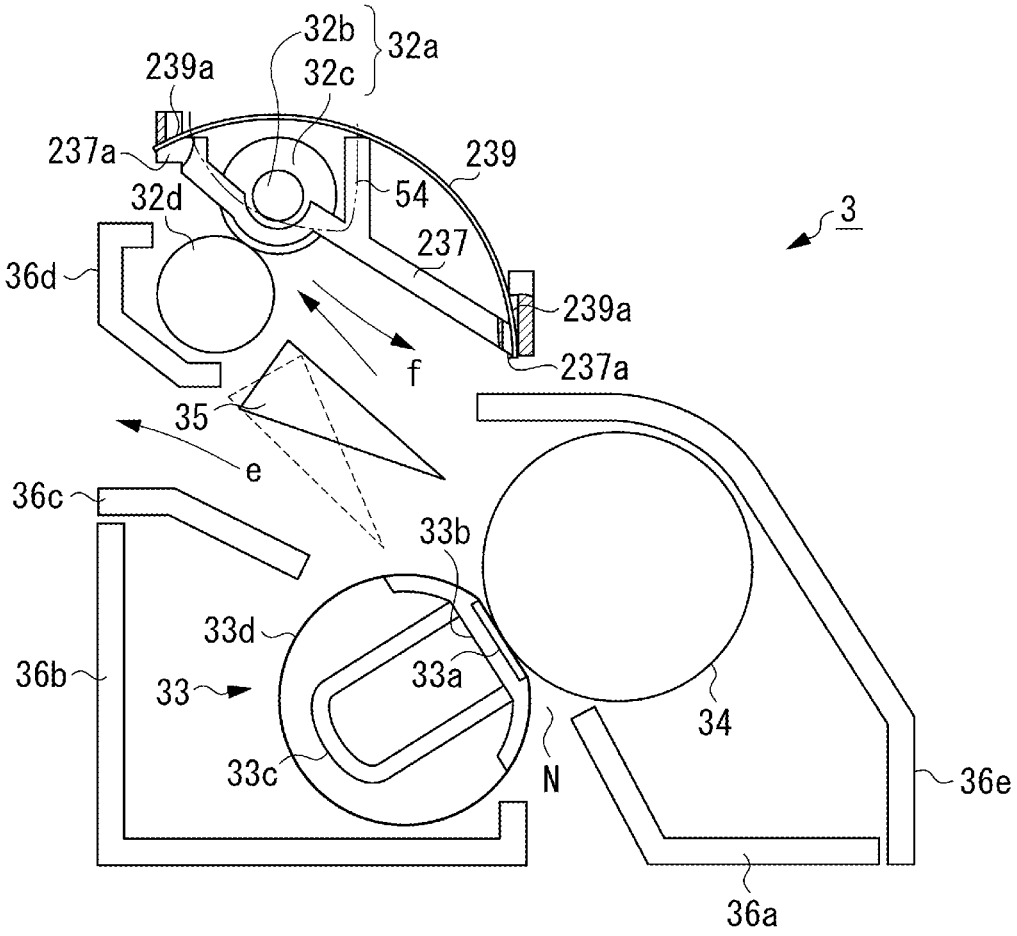
FIG. 9 is a cross-sectional view of a fixing unit according to a second exemplary embodiment.
Figure 10:
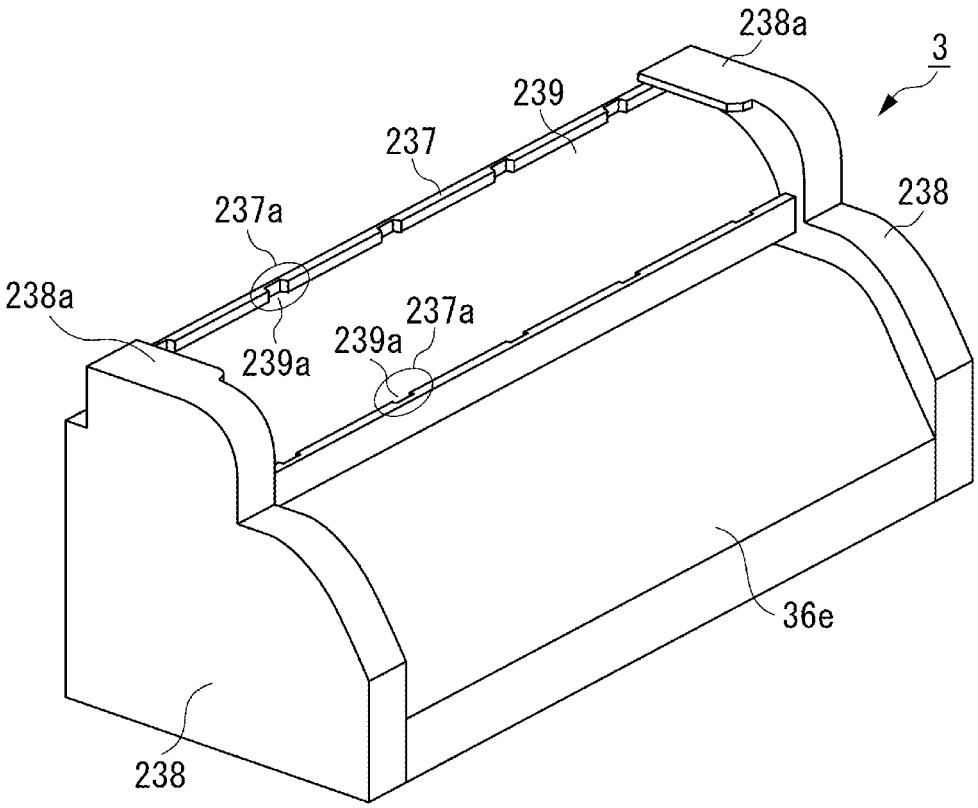
FIG. 10 is a perspective view of the fixing unit according to the second exemplary embodiment.

Next, a second exemplary embodiment will be described with reference to FIGS. 9 and 10. Parts that have the similar configuration as those described in the first exemplary embodiment are denoted by the same reference numerals. FIG. 9 is a cross-sectional view of a fixing unit. FIG. 10 is a perspective view of the fixing unit.

A cover member 237 (which also has a conveyance guide function) provided in a reversing conveyance path f is made of resin, and is produced by injection molding. The cover member 237 has a "U" shape (refer to a chain line 54 in FIG. 9) to perform injection molding with a cavity and a core, and is open in one direction. The cover member 237 covers the metal shaft 32*b* of the drive roller 32*a* from the conveyance path side of the recording material S. Consequently, the cover member 237 has an open part at the upper portion in FIG. 9.

A sheet member 239 is attached to the upper opening portion of the cover member 237. Since the sheet member is a thin material of about 0.4 mm, the apparatus main body E can be made more compact. The sheet member 239 is attached to the cover member 237 by fitting a protrusion 239*a* on the sheet member 239 into a notched portion 237*a* provided on the cover member 237. At this stage, the sheet member 239 is provided on the cover member 237 by the sheet member 239 bending. Further, the sheet member 239 is retained by a protrusion 238*a* provided on a side cover 238.

Therefore, assembly is simple, and disassembly using tools is easy. Further, such a configuration prevents deformation and disengagement due to differences in thermal expansion, and the occurrence of floating and peeling due to outgas produced by the resin being heated. The sheet member 239 is thinner than the other covers 36 that form the fixing unit 3. The sheet member 239 is produced by being molded into a sheet-shape by extrusion molding, for example, and punched into the final shape. Therefore, since a mold for injection molding is not required, the sheet member 39 is inexpensive. Further, a user warning is printed by silk printing from the rear face using a thin, transparent material (e.g., polycarbonate, polyethylene terephthalate, etc.). Since the flat portion of the sheet member 239 is wide, the printable area is wide and printing is easy. Further, printing flexibility is also high. In addition, since it is not necessary to add a label or the like, production costs are low.

The above-described first and second exemplary embodiments are cases that are applied to the cover member near the pair of reversing rollers 32 of the fixing unit 3. However, the exemplary embodiments of the present invention is not limited to the pair of reversing rollers 32, and may be applied to a configuration that covers the metal shaft of some other roller (e.g., the discharge roller 31) with the injection-molded cover member, and covers a portion that serves as the open part of the U-shaped portion with the sheet member. Further, instead of the fixing unit, the exemplary embodiments of the present invention may also be applied to a configuration that covers the metal shaft of the rotating member provided in the image forming apparatus main body with the injection-molded cover member, and covers a portion that serves as the open part of the U-shaped portion with the sheet member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169834 filed Jul. 31, 2012, which is hereby incorporated by reference herein in its entirety.

What is claimed is:

1. A fixing apparatus comprising:

a fixing unit configured to heat and fix an unfixed image, which is formed on a recording material;

a rotating member provided with a metal shaft and configured to convey the recording material that has passed through the fixing unit;

a cover member made of injection-molded resin and configured to cover the metal shaft of the rotating member from a recording material conveyance path side so that a portion of the rotating member in contact with the recording material is exposed, the cover member including a U-shaped portion that has a U-shaped cross-section when viewed from one end side of the metal shaft; and a sheet member configured to cover an opening of the U-shaped portion of the cover member.

2. The fixing apparatus according to claim 1, wherein a thickness of the sheet member is thinner than the cover member.

3. The fixing apparatus according to claim 1, wherein the sheet member is produced by punching.

4. The fixing apparatus according to claim 1, wherein a marking that warns of high temperatures is printed on the sheet member.

5. The fixing apparatus according to claim 1, wherein the sheet member is transparent.

6. The fixing apparatus according to claim 1, wherein the cover member includes a guide portion configured to guide movement of the recording material.

7. An image forming apparatus comprising:

an image forming unit configured to form an unfixed image on a recording material;

a fixing unit configured to heat and fix the unfixed image formed on the recording material;

a rotating member provided with a metal shaft and configured to convey the recording material that has passed through the fixing unit;

a cover member made of injection-molded resin and configured to cover the metal shaft of the rotating member from a recording material conveyance path side so that a portion of the rotating member in contact with the recording material is exposed, the cover member including a U-shaped portion that has a U-shaped cross-section when viewed from one end side of the shaft; and a sheet member configured to cover an opening of the U-shaped portion of the cover member.

8. The image forming apparatus according to claim 7, wherein a thickness of the sheet member is thinner than the cover member.

9. The image forming apparatus according to claim 7, wherein the sheet member is produced by punching.

10. The image forming apparatus according to claim 7, wherein a marking that warns of high temperatures is printed on the sheet member.

11. The image forming apparatus according to claim 7, wherein the sheet member is transparent.

12. The image forming apparatus according to claim 7, wherein the cover member includes a guide portion configured to guide movement of the recording material.

* * * * *